US006097827A

United States Patent [19]

Yang

[11] Patent Number: 6,097,827

[45] Date of Patent: Aug. 1, 2000

[54] ADJUSTABLE EARPHONE WITH A MICROPHONE

[75] Inventor: Bill Yang, Taipei, Taiwan

[73] Assignee: Cotron Corporation, Taipei, Taiwan

[21] Appl. No.: 09/250,632

[22] Filed: Feb. 16, 1999

[30] Foreign Application Priority Data

Dec. 19, 1998 [TW] Taiwan ..... 87221177

[51] Int. Cl.[7] ..... H04R 25/00

[52] U.S. Cl. ..... 381/375; 381/379; 381/381

[58] Field of Search ..... 381/309, 330, 381/322, 328, 370, 374, 375, 380, 381, FOR 134, FOR 149, FOR 150, 384; 374/430; 181/128

[56] References Cited

U.S. PATENT DOCUMENTS 5,210,792 5/1993 Kajihara ..... 381/381
5,298,692 3/1994 Ikeda et al. ..... 381/375
5,729,615 3/1998 Yang ..... 381/151
5,761,298 6/1998 Davis et al. ..... 381/430

*Primary Examiner*—Huyen Le
*Attorney, Agent, or Firm*—J.C. Patents; Jiawei Huang

[57] ABSTRACT

An adjustable earphone with a microphone has a hook, a speaker, and a microphone, in which the hook is used for comfortably mounting the earphone on a user's ear. The speaker is mounted in a speaker chamber that connects to the hook by an outrigger wherein the speaker can be firmly fixed on the user's exterior acoustic meatus. The microphone is mounted in a microphone chamber that connects to the hook by a boom, and the microphone chamber can be fixed near the user's mouth. A speaker signal-wire used for transmitting the signal extends from the speaker chamber, passes through the hook, and then couples to the audio signal manager. A microphone signal-wire used for transmitting the signals extends from the microphone chamber, passes by the boom, and then couples to the audio signal manager.

7 Claims, 5 Drawing Sheets

ADJUSTABLE EARPHONE WITH A MICROPHONE

CROSS-REFERENCE TO RELATED APPLICATION

This application claims the priority benefit of Taiwan application Ser. No. 87221177, filed Dec. 19, 1998, the full disclosure of which is incorporated herein by reference.

BACKGROUND OF THE INVENTION

1. Field of Invention

The present invention relates to an earphone. More particularly, the present invention relates to an adjustable earphone with a microphone.

2. Description of Related Art

People enjoy personal audio systems because users can listen to the radio, a tape, or a CD, without disturbing others and while simultaneously engaging in other activities. A personal audio system includes an earphone that is worn on the user's ear. Thus, only the user can hear the sound produced by the personal audio system and others are not disturbed. The earphone also provides better sound transmission, which allows the user to hear the sound more clearly than if the sound were mediated by the air. In addition, the sound transmitted by the earphone is not disturbed while the user is moving, exercising, or in a noisy environment. This type of earphone is also used in communication systems, such as educational, telephone or radio-communication systems. When the earphone is used in a communication system, a microphone is usually mounted on the earphone and extends to a location near the user's mouth. With such a system, the user can communicate with his or her hands free.

FIG. 1 illustrates a conventional earphone with a microphone. The earphone usually includes a speaker 10 and a microphone 12. The speaker 10 is so small that it can be fixed on the user's exterior acoustic meatus. The microphone 12 includes a clip 14 that allows the user to affix the microphone 14 in the location near the user's mouth, e.g., on the collar.

However, the convenience and the comfort for the user while wearing an earphone are very important. The speaker of the conventional earphone which tends to fall out of the ear causes discomfort when it is worn. In addition, the microphone needs to be clipped to something, but it is not always easy for the user to find a place to clip the microphone to. Thus the microphone may be attached at a distance from the user's mouth, so that the communication system is disturbed and noises are produced.

An earphone that can be comfortably worn by a user and can be firmly fixed on the user's ear while the user is exercising is disclosed in U.S. Pat. No. 5412736. An earphone with a microphone is disclosed in Taiwan application No. 87111485 based on U.S. Pat. No. 5412736, wherein both the signal-wire coupling to the microphone and the signal-wire coupling to the speaker pass through a slot in the hook of the earphone. After passing through the slot, one of the signal-wires couples to the speaker, and the other signal-wire couples to the microphone through a boom. It is difficult to fabricate, assemble, and use the earphone. In addition, if the user feels tired, due to extended wear of the earphone on one ear, and tries to move the earphone from one ear to another ear, e.g. from his right ear to his left ear, many steps are needed. These steps include: taking off the earphone, turning the speaker chamber, turning the boom which supports the microphone, adjusting the speaker chamber so that the speaker chamber can be affixed on the exterior acoustic meatus. etc.

SUMMARY OF THE INVENTION

The present invention provides an earphone with a microphone. The earphone includes a hook, a speaker, and a microphone. The speaker is in a speaker chamber and the microphone is in a microphone chamber, wherein the speaker chamber and the microphone chamber respectively protect the speaker and the microphone. The hook comprises a speaker end connecting to the speaker and a microphone end connecting to the microphone. When the earphone is worn on a user's ear, the hook extends along the user's helix, wherein the speaker end of the hook is near the upper side of the helix, and the microphone end of the hook is near the user's earlobe. The speaker of the earphone connects to the speaker end of the hook by an outrigger, and the microphone connects to the hook by a boom. The speaker signal-wire extends from the speaker and then passes through the outrigger, the speaker end of the hook, the slot in the hook and then couples to the audio signal manager. The microphone signal-wire extends from the microphone, passes through the boom and then couples to the audio signal manager.

Both the microphone signal-wire and the speaker signal-wire can be protected well in the invention. Additionally, fabrication of the earphone according to the invention is much easier.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
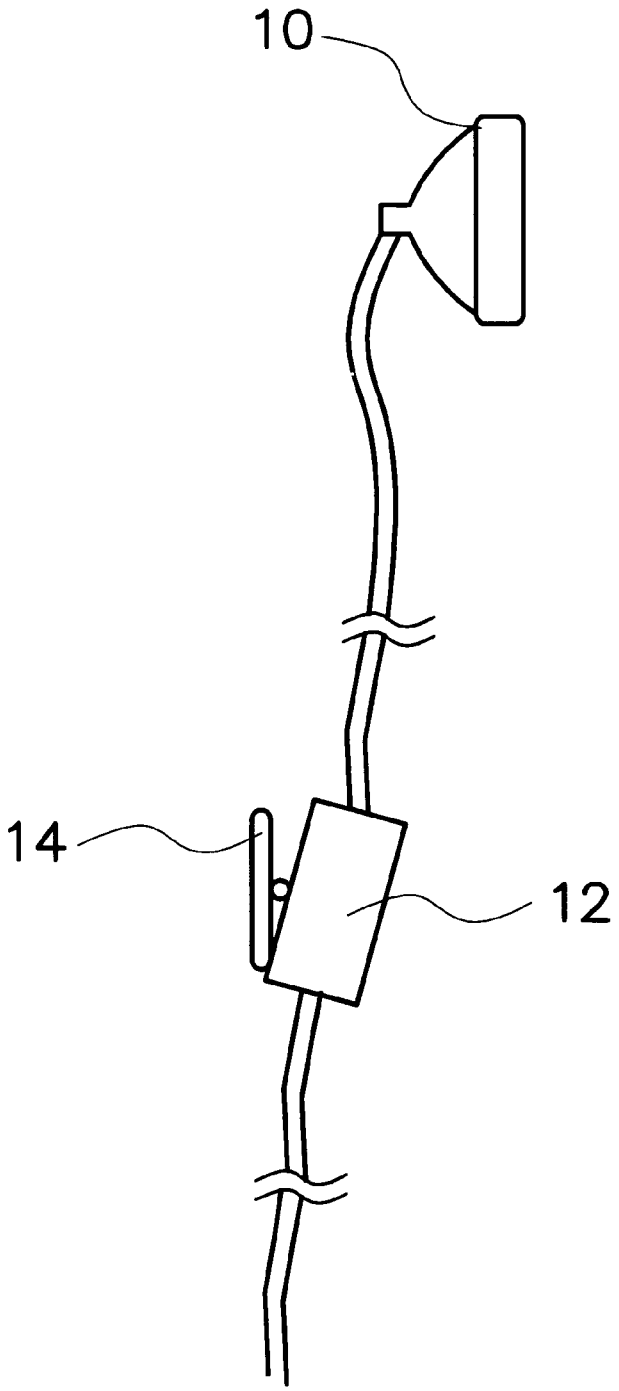
FIG. 1 (PRIOR ART)
FIG. 1 shows a schematic, front view of a conventional earphone with a microphone.

Reference will now be made in detail to the present preferred embodiments of the invention, examples of which are illustrated in the accompanying drawings. Wherever possible, the same reference numbers are used in the drawings and the description to refer to the same or like parts.

Figure 2:
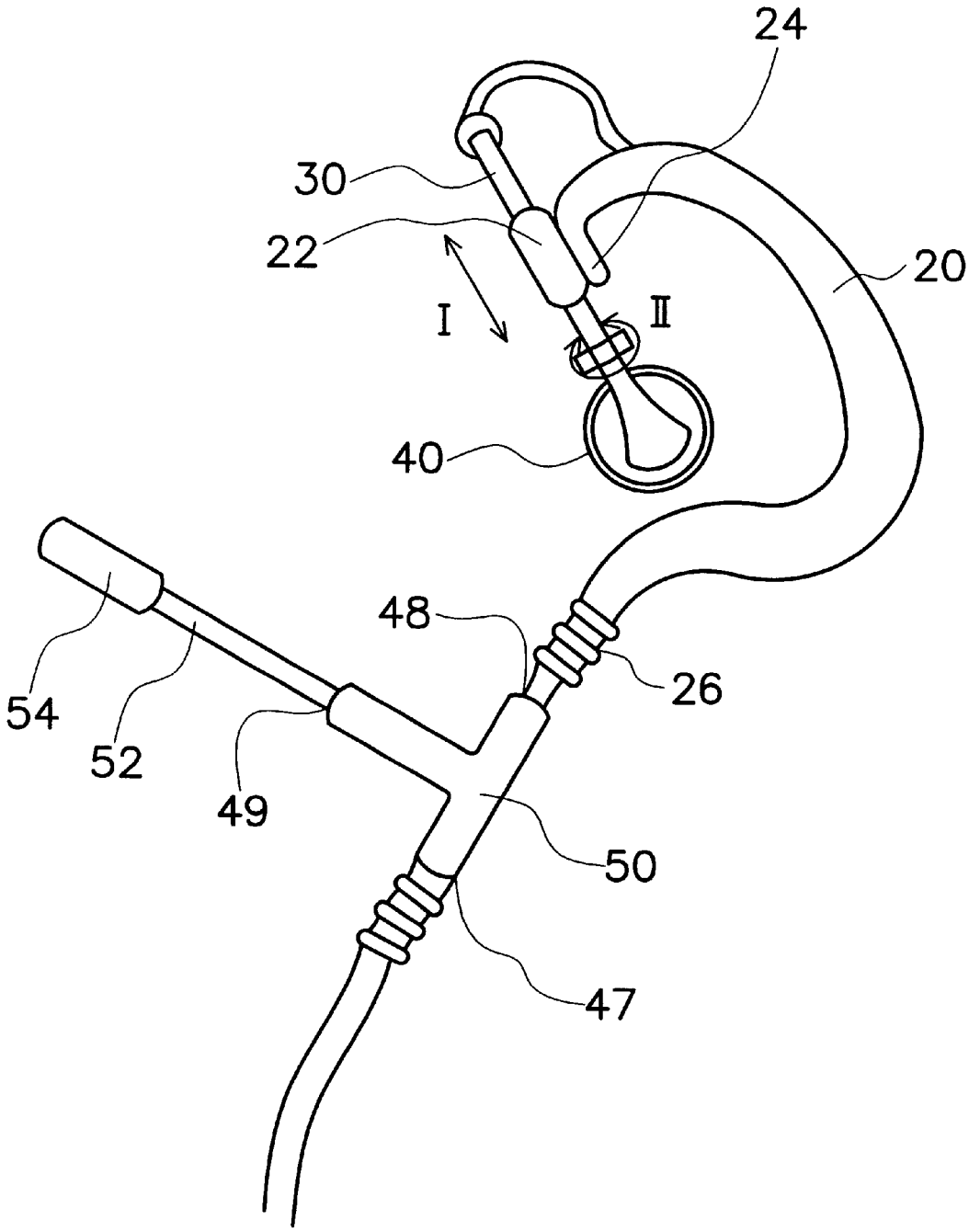
FIG. 2 shows a schematic, front view of the earphone with a microphone according to a preferred embodiment of the present invention.
Figure 3:
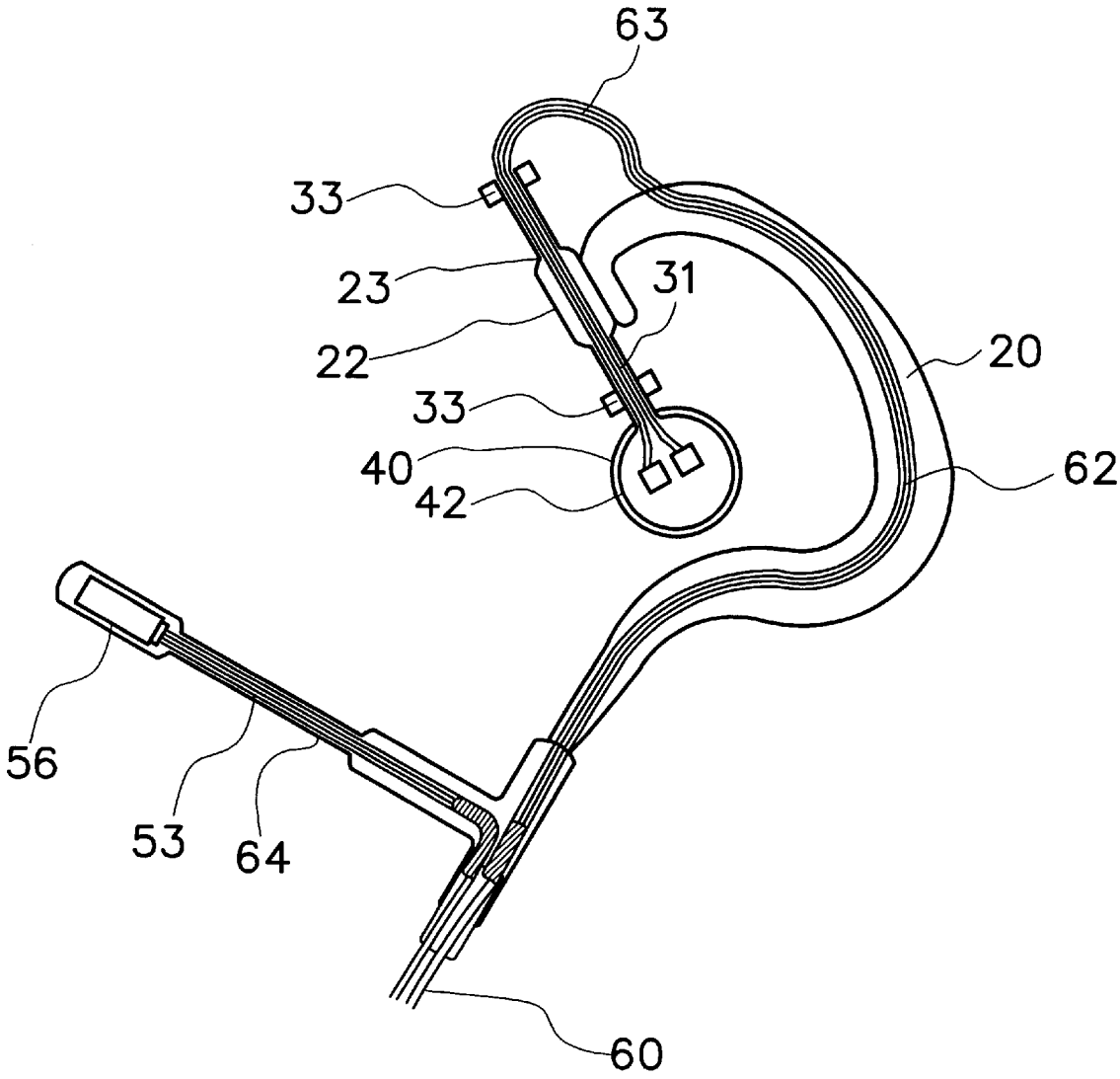
FIG. 3 shows a schematic, cross-sectional view of the earphone with a microphone as illustrated in FIG. 2.

FIG. 2 shows a front view of the earphone with a microphone according to a preferred embodiment of the present invention, and FIG. 3 shows a cross-sectional view of the earphone with a microphone in FIG. 2. As shown in FIG. 2 and in FIG. 3, the hook 20 is an apparatus that can be comfortably and firmly worn on a user's ear by extending and clipping along the user's ear. One end 24 of the hook 20 connects to the housing 22. An outrigger 30 passes through the housing 22 and connects to the speaker chamber 40. The speaker 42 is in the speaker chamber 40.

The user can slide the outrigger 30 upwardly or downwardly in the tunnel 23 of the housing 22 along the tunnel 23 along the direction of the arrowhead I. The user can also turn the outrigger 30 in the tunnel 23 of the housing 22 along the direction of the arrowhead II. While the force exerting on the outrigger 30 vanishes, the outrigger 30 will stay firmly because of the friction. Thus the direction and location of the speaker chamber 40 can be adjusted according to the user so that the speaker chamber 40 can be comfortably fixed on the user's exterior acoustic meatus. There are bulges 33 on both ends of the outrigger 30; the bulges 33 are at two ends of the outrigger 30. The bulges 33 prevent the outrigger 30 from slipping away from the housing 22.

Figure 4:
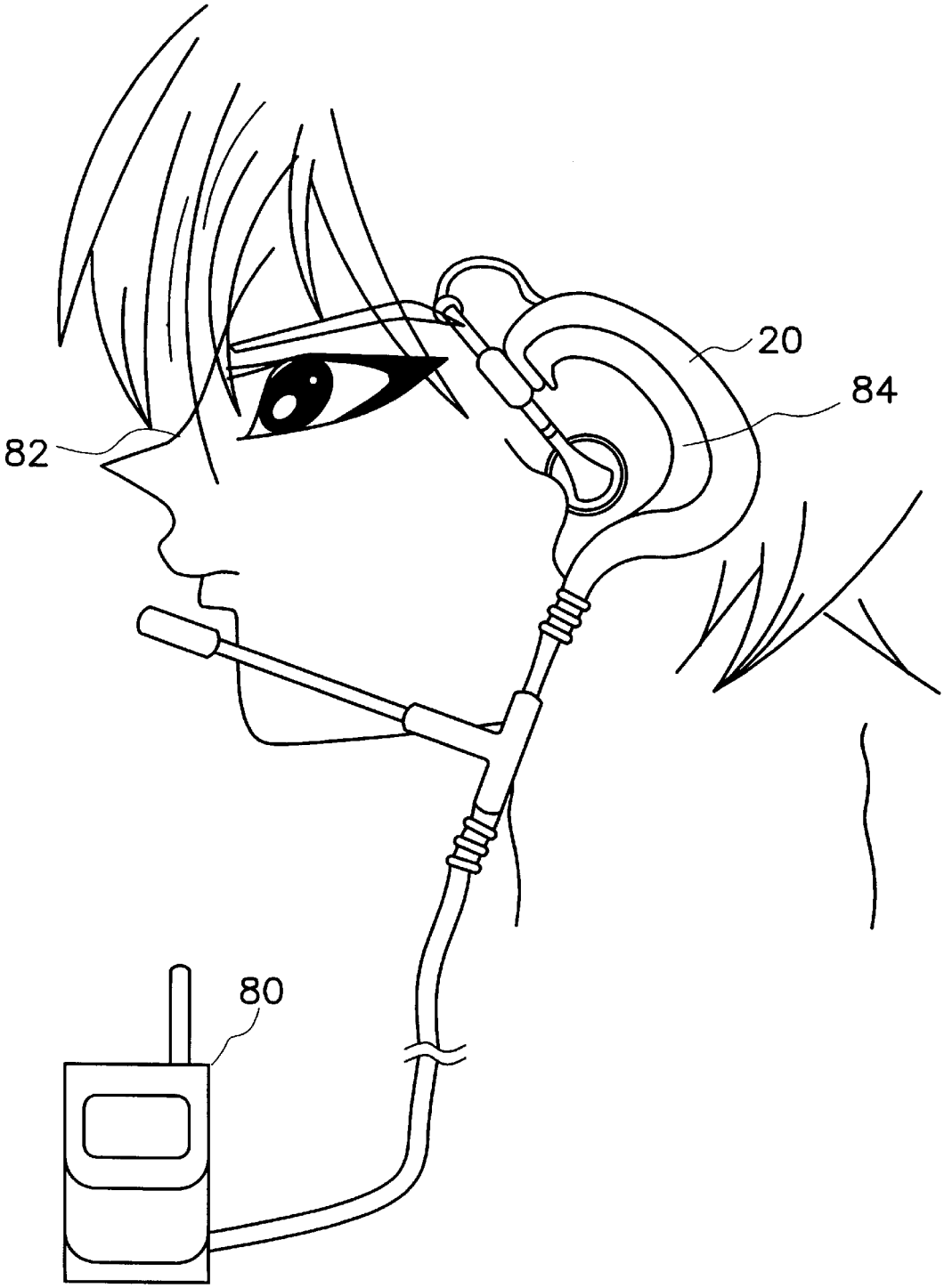
FIG. 4 shows a schematic, side view of the embodiment of the earphone with a microphone while being worn by a user.

FIG. 3 shows a cross-sectional view of the earphone with a microphone as illustrated in FIG. 2. As seen in FIG. 3, the outrigger 30 and the boom 52 are both hollow tubes. The hook 20 also includes a hollow passage therein. The signal-wire 62 extend from the speaker 42 and then extend into the bore 31 of the outrigger 30. After the signal-wire 62 passes through the outrigger 30, the signal-wire 62 form a loop 63 before entering the hook 20. The signal-wire 62 extend to one end 26 of the hook 20 after passing through the hook 20, and then the signal-wire 62 passes into the tri-bores housing 50. The loop 63 is a looser and less tensile part of the signal-wire 62, and the loop 63 exists to let the outrigger 30 move easily in the housing 22. The signal-wire 62 passes into the bore 48 of the tri-bore housing 50 after extending from the end 26 of the hook 20. The signal-wire 64 extends from the microphone 56 and passes into the bore 53 of the boom 52. The signal-wire 64 then passes into the bore 49 of the tri-bore housing 50 and extends from the bore 47. Finally, the signal-wire 64 couples to the audio signal manager. Referring to FIG. 3 and FIG. 4, signal-wire 62 and signal-wire 64 are usually combined into one wire 60. The wire 60 extends from the bore 47 of the tri-bore housing 50 and then connects to the end point for coupling to the audio signal manager 80. The audio signal manager 80 can be a communication means, e.g. mobile phone, wireless, multimedia, or radio intercom.

Referring to FIG. 2 and FIG. 3, one end of the boom 52 connects to the tri-bore housing 50, and the other end of the boom 52 connects to the microphone chamber 54. The boom 52 is a delicate and waterproof hollow tube used for covering and holding the microphone signal-wire 64. Additionally, the microphone is made from materials having high ductility because the boom 52 should be able to be bent easily by the user, and the boom 52 should maintain its configuration after being bent by the user. Thus the user can adjust the location of the microphone chamber 54 according to the location of the user's mouth when wearing the earphone with microphone of the invention.

If two earphones are used simultaneously, the signal-wire 60 can be plugged into a Y-type connector so that the signal from the audio signal manager can be transmitted to both of the earphones. If needed, a volume controller and a switch can also be installed on the signal-wire 60 for the user to control the On/Off State and the volume easily.

Figure 5:
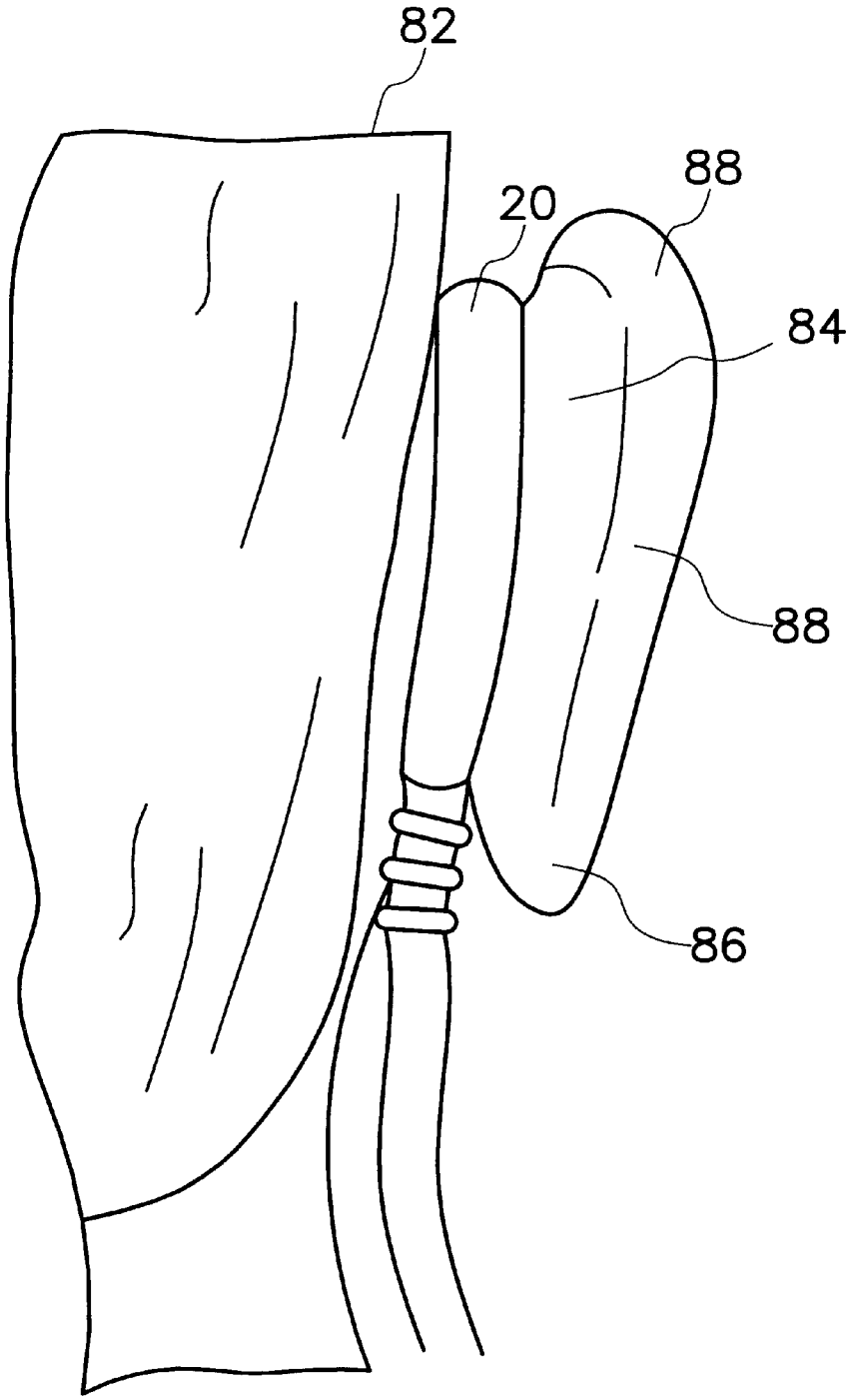
FIG. 5 shows a schematic view from the rear side of the head of a user while the earphone with a microphone according to a preferred embodiment of the invention is worn by a user.

FIG. 4 shows a side view of the embodiment of the earphone with a microphone while being worn by a user, and FIG. 5 shows a view from the rear side of the head of a user wherein the earphone with a microphone is worn on the user's ear. Referring to FIG. 4 and FIG. 5, the hook 20 extends from a location near the earlobe 86 to a location near the upper side of the helix 88. The hook 20 is designed according to the shape of the ear and thus it is comfortable for the user to wear the earphone on his or her ear. One end 26 of the hook 20 is at the rear side of the ear near the earlobe 86, and the other end 24 of the hook 20 connects to a housing 22 on the upper side of the helix 88. Thus the hook 20 cannot easily fall from the ear. Additionally, after wearing the earphone according to embodiment of the invention, the user can adjust the outrigger 30 that connects to the speaker chamber 40 and the hook 20 enable the speaker chamber to be located in a more comfortable position. The hook 20 and the outrigger 30 also keep the speaker 42 and the speaker chamber 40 on the exterior acoustic meatus even when the user is engaged in vigorous physical activity.

Generally, high quality speakers always have a metal buffer cap. But when the user is engaged in vigorous physical activities, the sweat and the humidity still erode the earphone. To resolve this problem, the speaker of the invention has a waterproof material covering the the metal buffer cap. The waterproof material can be made from latex. The waterproof material is interleaved between the metal buffer cap and a scale-proof meshes, and than sealed by an elastic seal.

Some people need their hands free and have to pay attention to the surroundings while working, thus the earphone with a microphone according to their invention is very important. Sometimes they may feel tired after wearing the earphone on the same ear for a long time and try to move the earphone from one ear to another ear. At such a time, the user just needs to take off the earphone and turn the speaker chamber 40 about 180°, after which then the earphone can be worn on the other ear. While the user engages in vigorous physical activity, the housing prevents the outrigger 30 from turning or moving due to friction, and thus the speaker chamber 40 does not turn nor move. As a result, the user still feels comfortable even during vigorous activity.

It will be apparent to those skilled in the art that various modifications and variations can be made to the structure of the present invention without departing from the scope or spirit of the invention. In view of the foregoing, it is intended that the present invention shield modifications and variations of this invention provided they fall within the scope of the following claims and their equivalents.

What is claimed is:

1. An adjustable earphone with a microphone comprising:

a hook, used for mounting on a user's ear along a rearward side of an ear of the user, wherein the hook comprises a microphone end and a speaker end;

a speaker, used for mounting on an exterior acoustic meatus of the ear of the user;

a microphone;

an outrigger on the speaker end, whereby the speaker couples to the speaker end of the hook with an adjustable location to the ear by sliding and rotation;

a boom, whereby the microphone couples to the microphone end of the hook, wherein the boom can be bent and is used to hold the microphone at a desired location;

a speaker signal-wire coupling to the speaker; and a microphone signal-wire coupling to the microphone, wherein the speaker signal-wire and the microphone signal-wire enter the adjustable earphone from the microphone end.

2. The adjustable earphone with a microphone according to claim 1, wherein the speaker signal-wire passes through the hook, the speaker end of the hook, and the outrigger, and the microphone signal-wire passes through the boom.

3. The adjustable earphone with a microphone according to claim 1, further comprising a tri-bore housing installed between the microphone end of the hook and the boom, wherein the speaker signal-wire passes into a speaker-connecting bore of the tri-bore housing, the microphone signal-wire passes into a microphone-connecting bore of the tri-bore housing, and both the speaker signal-wire and the microphone signal-wire extend from the main bore of the tri-bore housing.

4. The adjustable earphone with a microphone according to claim 1, further comprising a speaker chamber used for covering the speaker and the hook further comprising a housing, wherein the outrigger is installed and held in the housing, so that the outrigger can be moved and turned in the housing for adjusting the speaker chamber and keeping the speaker on the exterior acoustic meatus of the user.

5. The adjustable earphone with a microphone according to claim 1, the outrigger further comprising a bulge on the outrigger for preventing the outrigger from sliding away from the housing.

6. The adjustable earphone with a microphone according to claim 1, further comprising a speaker chamber and microphone chamber used for covering the speaker and the microphone, respectively.

7. The adjustable earphone with a microphone according to claim 1, wherein the boom is a hollow tube and is made from materials having high ductility.

* * * * *